US008662937B2

(12) United States Patent
Tian et al.

(10) Patent No.: US 8,662,937 B2
(45) Date of Patent: Mar. 4, 2014

(54) AUDIO JACK AND ELECTRONIC APPARATUS CONTAINING THE SAME

(75) Inventors: Xiyong Tian, Beijing (CN); Lingchang Li, Beijing (CN); Yinong Liu, Beijing (CN)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 0 days.

(21) Appl. No.: 13/556,600

(22) Filed: Jul. 24, 2012

(65) Prior Publication Data

US 2013/0029535 A1 Jan. 31, 2013

(30) Foreign Application Priority Data

Jul. 28, 2011 (CN) ..... 2011 1 0214112

(51) Int. Cl.
*H01R 24/00* (2011.01)

(52) U.S. Cl.
USPC ..... 439/668

(58) Field of Classification Search
USPC ..... 439/668–669, 79–80
See application file for complete search history.

(56) References Cited

U.S. PATENT DOCUMENTS

| | | | | |
|---|---|---|---|---|
| 7,387,543 | B1 * | 6/2008 | Wu et al. | 439/668 |
| 7,445,515 | B1 * | 11/2008 | Yuan et al. | 439/668 |
| 7,534,146 | B2 * | 5/2009 | Chien et al. | 439/668 |
| 7,753,738 | B2 * | 7/2010 | Zhang | 439/668 |
| 7,794,285 | B1 * | 9/2010 | Huang | 439/668 |
| 8,123,569 | B2 * | 2/2012 | Little et al. | 439/669 |
| 8,251,753 | B2 * | 8/2012 | Guo et al. | 439/668 |
| 2007/0249235 | A1 * | 10/2007 | Wu | 439/668 |
| 2009/0176414 | A1 | 7/2009 | Chien et al. | |

FOREIGN PATENT DOCUMENTS

WO 2007049175 A2 5/2007

OTHER PUBLICATIONS

Extended European Search Report with Written Opinion dated Jan. 9, 2013 corresponding to European Patent Application No. 12005460.6 filed Jul. 26, 2012.

* cited by examiner

*Primary Examiner* — Jean F Duverne
(74) *Attorney, Agent, or Firm* — Renner, Otto, Boisselle & Sklar, LLP

(57) ABSTRACT

The present invention provides an audio jack and electronic apparatus containing the same. The audio jack includes a hollow insulated housing, wherein the insulated housing includes: a fixed portion and a rotating portion rotating relative to the fixed portion and on which at least two elastic terminals are arranged; and the at least two elastic terminals of the rotating portion being in contact with different pins of a printed circuit board of the audio jack respectively when the rotating portion is in a first position and rotates relative to the fixed portion to a second position. The audio jack and electronic apparatus containing the same of the present invention are applicable to the insertion of plugs of different specifications, increasing the range of application of the electronic apparatus on the premise of reducing the cost of the electronic apparatus.

14 Claims, 6 Drawing Sheets

AUDIO JACK AND ELECTRONIC APPARATUS CONTAINING THE SAME

TECHNICAL FIELD

The present invention relates to an audio jack of an electronic apparatus, and in particular to an audio jack adapted to pins of different specifications and electronic apparatus containing the same.

BACKGROUND ART

An electronic apparatus with an audio output, such as a computer, a walkman, a mobile phone, PDA (Personal Digital Assistant), an MP3 (Moving Picture Experts Group Audio Layer III) and an MP4 (Moving Picture Experts Group Audio Layer IV), etc., is usually provided with an audio jack available for connecting an earphone or an external speaker to facilitate a user to select use of an earphone for listening or use of a speaker to enlarge the audio range. A 3.5 mm earphone interface is widely used in the design of audio jacks of various electronic apparatuses. However, different industries have different definitions of the pins of the plugs of earphones. The audio jacks of electronic apparatuses should be designed differently to be adapted for the earphone plugs of the specifications of different industries and accordingly, the PCBs (Printed Circuit Boards) of these electronic apparatuses should be designed differently.

FIG. 1*a* is a schematic diagram of the pin definition of an earphone plug in conformity with CTIA (Cellular Telecommunications & Internet Association) specification. As shown in FIG. 1*a*, in accordance with the pin definition of the CTIA specification, the earphone plug 100 starts from an insertion end, and has an audio left pin 111, an audio right pin 112, a GND pin 113 and an MIC pin 114, respectively. It can be seen that the innermost pin of the earphone plug in conformity with the CTIA specification is the MIC pin. FIG. 1*b* is a schematic diagram of the pin definition of an earphone plug 119 in conformity with OMTP (Open Mobile Terminal Platform) specification. As shown in FIG. 1*b*, in accordance with the pin definition of the OMTP specification, the earphone plug 119 starts from an insertion end 120, and has an audio left pin 121, an audio right pin 122, an MIC pin 123 and a GND pin 124, respectively. It can be seen that the innermost pin of the earphone plug in conformity with the OMTP specification is the GND pin. It can be seen from FIGS. 1*a* and 1*b*, the MIC pin and the GND pin are interchanged for the earphone plugs of different specifications.

FIG. 2*a* is a schematic diagram showing a design of an audio jack 210 in conformity with the CTIA specification. As shown in FIG. 2*a*, the audio jack has seven conductive terminals 211-217; wherein the conductive terminal 211 is connected to the MIC pin of the earphone plug, the conductive terminal 212 is connected to the GND pin of the earphone plug, the conductive terminal 216 is connected to the audio right pin of the earphone plug, the conductive terminal 213 is connected to the audio left pin of the earphone plug, and the conductive terminals 214 and 215 are detection terminals. In addition, each of the conductive terminals is respectively connected to each of the pins of the PCB of the audio jack.

FIG. 2*b* is a schematic diagram showing a design of an audio jack 220 in conformity with the OMTP specification. As shown in FIG. 2*b*, the audio jack has seven conductive terminals 221-226; wherein the conductive terminal 221 is connected to the GND pin of the earphone plug, the conductive terminal 222 is connected to the MIC pin of the earphone plug, the conductive terminal 226 is connected to the audio right pin of the earphone plug, the conductive terminal 223 is connected to the audio left pin of the earphone plug, and the conductive terminals 224 and 225 are detection terminals. Likewise, each of the conductive terminals is furthermore connected to each of the pins of the PCB 227 of the audio jack, respectively.

SUMMARY OF THE INVENTION

It is found by the applicant in the implementation of the present invention that since the definitions of the pins of the earphone plug are different, not only the audio jacks are required to have different designs, but also the corresponding PCBs should have different designs, increasing the cost of manufacture and range of application of the electronic apparatus undoubtedly. The range of application of an electronic apparatus using an audio jack will be wider and the cost will be lower if such an audio jack is provided which is applicable to both the CTIA specification and the OMTP specification.

The present invention is proposed in view of the above problems of the prior art.

An aspect of the present invention is to overcome the defect of the existing audio jack that is applicable only to the plug of one specification and to provide an audio jack applicable to plugs of different specifications and an electronic apparatus containing the audio jack. The problem to be solved is to increase the range of application of the electronic apparatus on the premise of reducing the cost of the electronic apparatus.

Aspects of the invention and solving the technical problem are achieved by the following technical solution.

According to a first aspect of the present invention, there is provided an audio jack, including a hollow insulated housing, wherein the insulated housing includes: a fixed portion and a rotating portion rotating relative to the fixed portion and on which at least two elastic terminals are arranged; and the at least two elastic terminals of the rotating portion being in contact with different pins of a printed circuit board of the audio jack respectively when the rotating portion is in a first position and rotates relative to the fixed portion to a second position.

According to a second aspect of the present invention, there is provided an audio jack as stated in the first aspect, wherein, a first elastic terminal and a second elastic terminal are arranged on the rotating portion and have respectively a first extending portion and a second extending portion and a body portion arranged between the first extending portion and the second extending portion;

when the rotating portion is at the first position, the first extending portion of the first elastic terminal is in contact with a first pin of the printed circuit board of the audio jack, and the first extending portion of the second elastic terminal is in contact with a second pin of the printed circuit board of the audio jack; and when the rotating portion rotates relative to the fixed portion to the second position, the second extending portion of the second elastic terminal is in contact with the first pin of the printed circuit board of the audio jack, and the second extending portion of the first elastic terminal is in contact with the second pin of the printed circuit board of the audio jack.

According to a third aspect of the present invention, there is provided an audio jack as stated in the second aspect, wherein the body portion of the first elastic terminal is arranged at a first side of the rotating portion; the first extending portion of the first elastic terminal is arranged at a second side of the rotating portion perpendicular to the first side, close to the opening and exposed from the rotating portion; the second extending portion of the first elastic terminal is arranged at a third side of the rotating portion perpendicular to the first side, close to the fixed portion and exposed from the rotating portion; wherein the projections of the first extending portion of the first elastic terminal and the second extending portion of the first elastic terminal on the plane of the second side or the third side of the rotating portion are spaced apart at a certain distance.

According to a fourth aspect of the present invention, there is provided an audio jack as stated in the third aspect, wherein the body portion of the second elastic terminal is arranged at a fourth side of the rotating portion in parallel with the first side; the first extending portion of the second elastic terminal is arranged at the second side of the rotating portion perpendicular to the first side, close to the fixed portion and exposed from the rotating portion; the second extending portion of the second elastic terminal is arranged at the third side of the rotating portion perpendicular to the first side, close to the opening and exposed from the rotating portion; wherein the projections of the first extending portion of the second elastic terminal and the second extending portion of the second elastic terminal on the plane of the second side or the third side of the rotating portion are spaced apart at a certain distance.

According to a fifth aspect of the present invention, there is provided an audio jack as stated in the fourth aspect, wherein the projections of the first extending portion of the first elastic terminal and the second extending portion of the second elastic terminal on the plane of the second side or the third side of the rotating portion are overlapped; and the projections of the second extending portion of the first elastic terminal and the first extending portion of the second elastic terminal on the plane of the second side or the third side of the rotating portion are overlapped.

According to a sixth aspect of the present invention, there is provided an audio jack as stated in any of the first to the fifth aspects, wherein the first pin is a GND contact pad, and the second pin is an MIC contact pad; or the first pin is an MIC contact pad, and the second pin is a GND contact pad.

According to a seventh aspect of the present invention, there is provided an audio jack as stated in any of the first to the fifth aspects, wherein the rotating portion and the fixed portion are connected in a nested manner, and a clamp for preventing the rotating portion from sliding relative to the fixed portion is arranged at the position where the rotating portion and the fixed portion are connected.

According to an eighth aspect of the present invention, there is provided an electronic apparatus, including an audio jack, and the audio jack including a hollow insulated housing, wherein, the insulated housing includes: a fixed portion and a rotating portion rotating relative to the fixed portion and on which at least two elastic terminals are arranged; and the at least two elastic terminals of the rotating portion being in contact with different pins of a printed circuit board of the audio jack respectively when the rotating portion is in a first position and rotates relative to the fixed portion to a second position.

According to a ninth aspect of the present invention, there is provided an electronic apparatus as stated in the eighth aspect, wherein, a first elastic terminal and a second elastic terminal are arranged on the rotating portion and have respectively a first extending portion and a second extending portion and a body portion arranged between the first extending portion and the second extending portion;

when the rotating portion is at the first position, the first extending portion of the first elastic terminal is in contact with a first pin of the printed circuit board of the audio jack, and the first extending portion of the second elastic terminal is in contact with a second pin of the printed circuit board of the audio jack; and when the rotating portion rotates relative to the fixed portion to the second position, the second extending portion of the second elastic terminal is in contact with the first pin of the printed circuit board of the audio jack, and the second extending portion of the first elastic terminal is in contact with the second pin of the printed circuit board of the audio jack.

According to a tenth aspect of the present invention, there is provided an electronic apparatus as stated in the ninth aspect, wherein the body portion of the first elastic terminal is arranged at a first side of the rotating portion; the first extending portion of the first elastic terminal is arranged at a second side of the rotating portion perpendicular to the first side, close to the opening and exposed from the rotating portion; the second extending portion of the first elastic terminal is arranged at a third side of the rotating portion perpendicular to the first side, close to the fixed portion and exposed from the rotating portion; wherein the projections of the first extending portion of the first elastic terminal and the second extending portion of the first elastic terminal on the plane of the second side or the third side of the rotating portion are spaced apart at a certain distance.

According to an eleventh aspect of the present invention, there is provided an electronic apparatus as stated in the tenth aspect, wherein the body portion of the second elastic terminal is arranged at a fourth side of the rotating portion in parallel with the first side; the first extending portion of the second elastic terminal is arranged at the second side of the rotating portion perpendicular to the first side, close to the fixed portion and exposed from the rotating portion; the second extending portion of the second elastic terminal is arranged at the third side of the rotating portion perpendicular to the first side, close to the opening and exposed from the rotating portion; wherein the projections of the first extending portion of the second elastic terminal and the second extending portion of the second elastic terminal on the plane of the second side or the third side of the rotating portion are spaced apart at a certain distance.

According to a twelfth aspect of the present invention, there is provided an electronic apparatus as stated in the eleventh aspect, wherein the projections of the first extending portion of the first elastic terminal and the second extending portion of the second elastic terminal on the plane of the second side or the third side of the rotating portion are overlapped; and the projections of the second extending portion of the first elastic terminal and the first extending portion of the second elastic terminal on the plane of the second side or the third side of the rotating portion are overlapped.

According to a thirteenth aspect of the present invention, there is provided an electronic apparatus as stated in any of the eighth to the twelfth aspects, wherein the first pin is a GND contact pad, and the second pin is an MIC contact pad; or the first pin is an MIC contact pad, and the second pin is a GND contact pad.

According to a fourteenth aspect of the present invention, there is provided an electronic apparatus as stated in any of the eighth to the twelfth aspects, wherein the rotating portion and the fixed portion are connected in a nested manner, and a clamp for preventing the rotating portion from sliding relative to the fixed portion is arranged at the position where the rotating portion and the fixed portion are connected.

Advantages of the present invention exist in that the audio jack and the electronic apparatus containing the audio jack of the present invention are applicable to the insertion of plugs of various specifications, increasing the range of application of the electronic apparatus on the premise of reducing the cost of the electronic apparatus.

These and further aspects and features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the appended claims.

Features that are described and/or illustrated with respect to one embodiment may be used in the same way or in a similar way in one or more other embodiments and/or in combination with or instead of the features of the other embodiments.

It should be emphasized that the term "includes/including" when used in this specification is taken to specify the presence of stated features, integers, steps or components but does not preclude the presence or addition of one or more other features, integers, steps, components or groups thereof.

Many aspects of the invention can be better understood with reference to the following drawings. The components in the drawings are not necessarily to scale, emphasis instead being placed upon clearly illustrating the principles of the present invention. To facilitate illustrating and describing some parts of the invention, corresponding portions of the drawings may be exaggerated in size, e.g., made larger in relation to other parts than in an exemplary device actually made according to the invention. Elements and features depicted in one drawing or embodiment of the invention may be combined with elements and features depicted in one or more additional drawings or embodiments. Moreover, in the drawings, like reference numerals designate corresponding parts throughout the several views and may be used to designate like or similar parts in more than one embodiment. Some same parts may be designated by different reference numerals, e.g. rotating portion 312 shown in FIG. 3 also is designated 61 in FIGS. 6*a* and 6*b*, and so on.

BRIEF DESCRIPTION OF THE DRAWINGS

The drawings are included to provide further understanding of the present invention, which constitute a part of the specification and illustrate the preferred embodiments of the present invention, and are used for setting forth the principles of the present invention together with the description. The same element is represented mostly with the same reference number throughout the drawings. In the drawings.

DETAILED DESCRIPTION OF THE INVENTION

The interchangeable terms "electronic apparatus" and "electronic device" include portable radio communication apparatus. The term "portable radio communication apparatus", which hereinafter is referred to as a "mobile terminal", "portable electronic device", or "portable communication device", includes all apparatuses such as mobile telephones, pagers, communicators, electronic organizers, personal digital assistants (PDAs), smartphones, portable communication devices or the like.

In the present application, embodiments of the invention are described primarily in the context of a portable electronic device in the form of a mobile telephone (also referred to as "mobile phone"). However, it shall be appreciated that the invention is not limited to the context of a mobile telephone and may relate to any type of appropriate electronic apparatus having the function of photographing and sound recording.

The preferred embodiments of the present invention are described as follows in reference to the drawings.

Figure 1A:
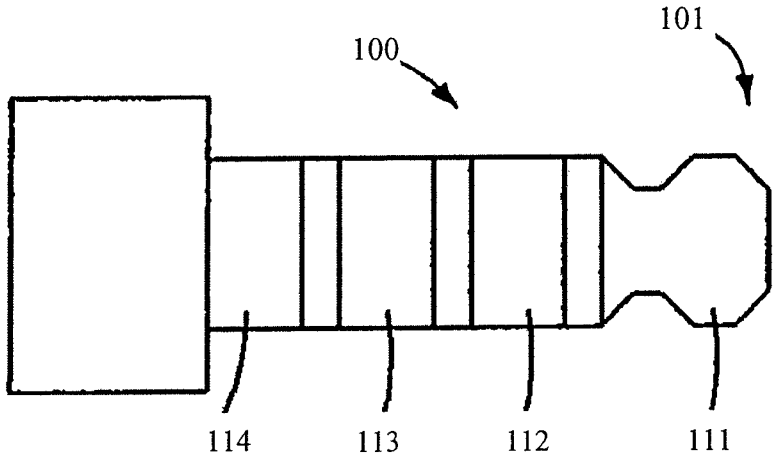
FIG. 1*a* illustrates a schematic diagram of the pin definition of an earphone plug in conformity with the CTIA specification.
Figure 1B:
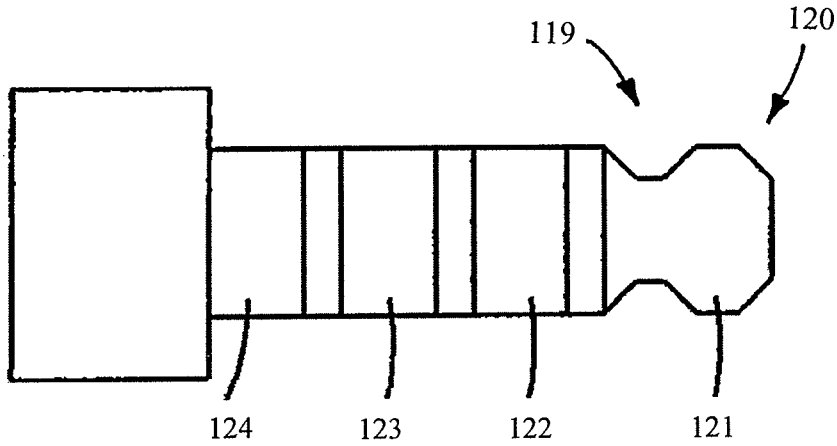
FIG. 1*b* illustrates a schematic diagram of the pin definition of an earphone plug in conformity with the OMTP specification.
Figure 2A:
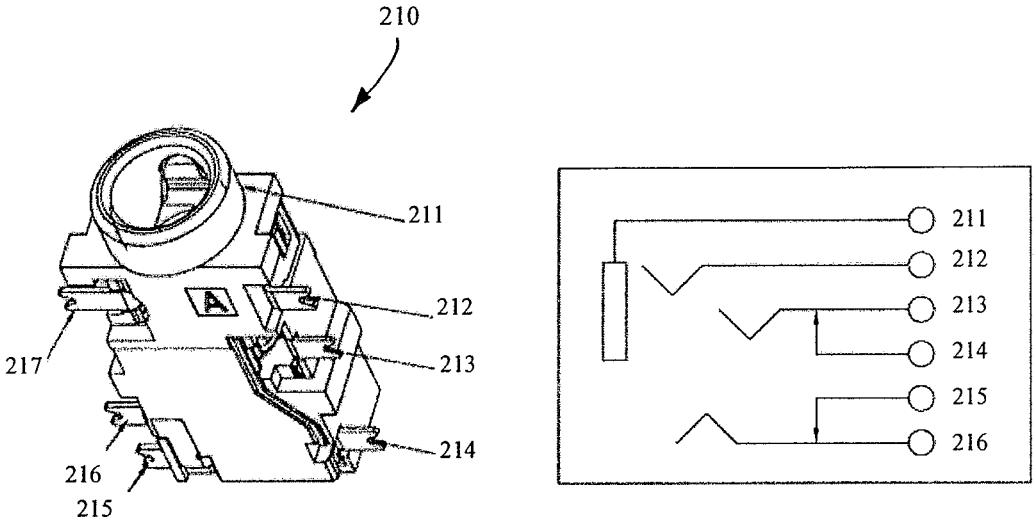
FIG. 2*a* illustrates a schematic diagram of a design of an audio jack in conformity with the CTIA specification.
Figure 2B:
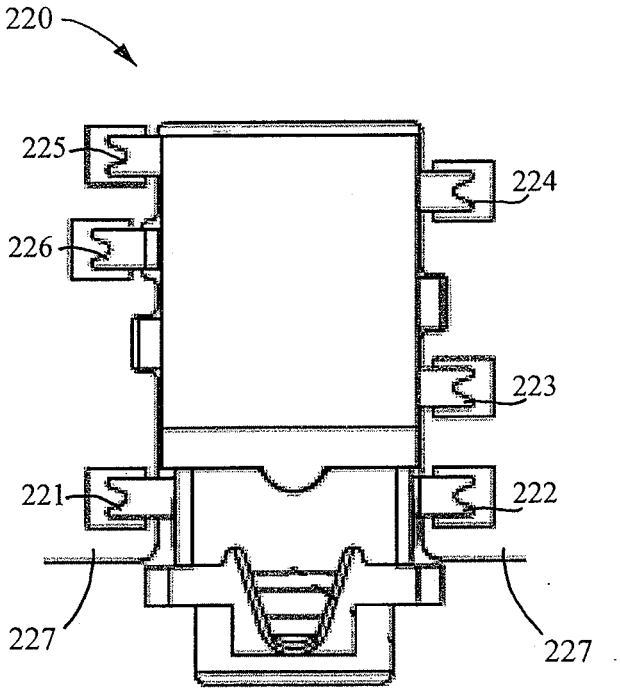
FIG. 2*b* illustrates a schematic diagram of a design of an audio jack in conformity with the OMTP specification.
Figure 3:
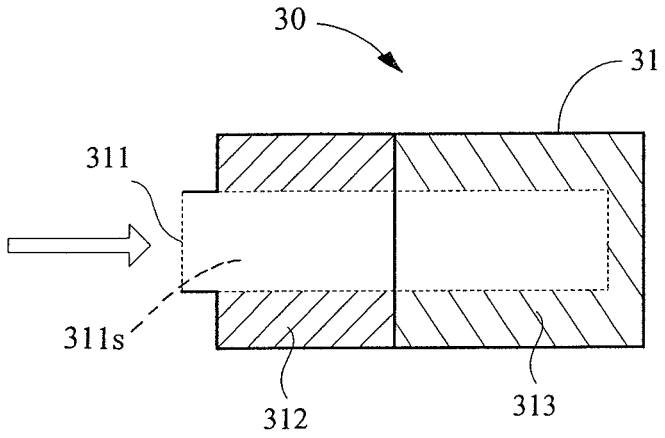
FIG. 3 illustrates a schematic diagram of the structure of an audio jack according to an embodiment of the present invention.

FIG. 3 illustrates a schematic diagram of the structure of an audio jack 30 according to an embodiment of the present invention. The audio jack is for the insertion of a plug, and the plug may be an earphone plug, or may be a speaker plug.

Referring to FIG. 3, the audio jack includes a hollow insulated housing 31 having an opening 311, with an accommodation space 311*s* being formed within the insulated housing 31 for accommodating a plug inserted from the opening 311. A plurality of elastic terminals (not shown in this figure) are arranged on the insulated housing 31.

In this embodiment, the insulated housing 31 includes a rotating portion 312 and a fixed portion 313 connected to the rotating portion 312, and the rotating portion 312 may rotate relative to the fixed portion 313. In an embodiment, the rotating portion 312 and the fixed portion 313 are connected in a nested manner and hence, the rotating portion 312 may rotate free relative to the fixed portion 313. In this embodiment, the manner of the connection of the rotating portion 312 and the fixed portion 313 is not limited, as long as the rotating portion 312 may rotate free relative to the fixed portion 313, which are covered by the protection scope of the present invention. A clamp structure may be arranged at the position where the rotating portion 312 and the fixed portion 313 are connected, so as to prevent the rotating portion 312 from sliding relative to the fixed portion 313. When the rotating portion 312 rotates relative to the fixed portion 313 to a certain angle, the rotating portion 312 may be fixed by the clamp structure, so as to prevent the rotating portion 312 from rotating overmuch, affecting the use of the audio jack.

In this embodiment, the insulated housing includes: a fixed portion 313 and a rotating portion 312 rotating relative to the fixed portion and on which at least two elastic terminals (not shown in this drawing figure) are arranged. The at least two elastic terminals of the rotating portion are in contact with different pins of a printed circuit board of the audio jack when the rotating portion is in a first position, and rotate relative to the fixed portion to a second position.

In this embodiment, two of the plurality of elastic terminals are arranged at the rotating portion 312, and other elastic terminals of the plurality of elastic terminals are arranged at the fixed portion 313.

Figure 4:
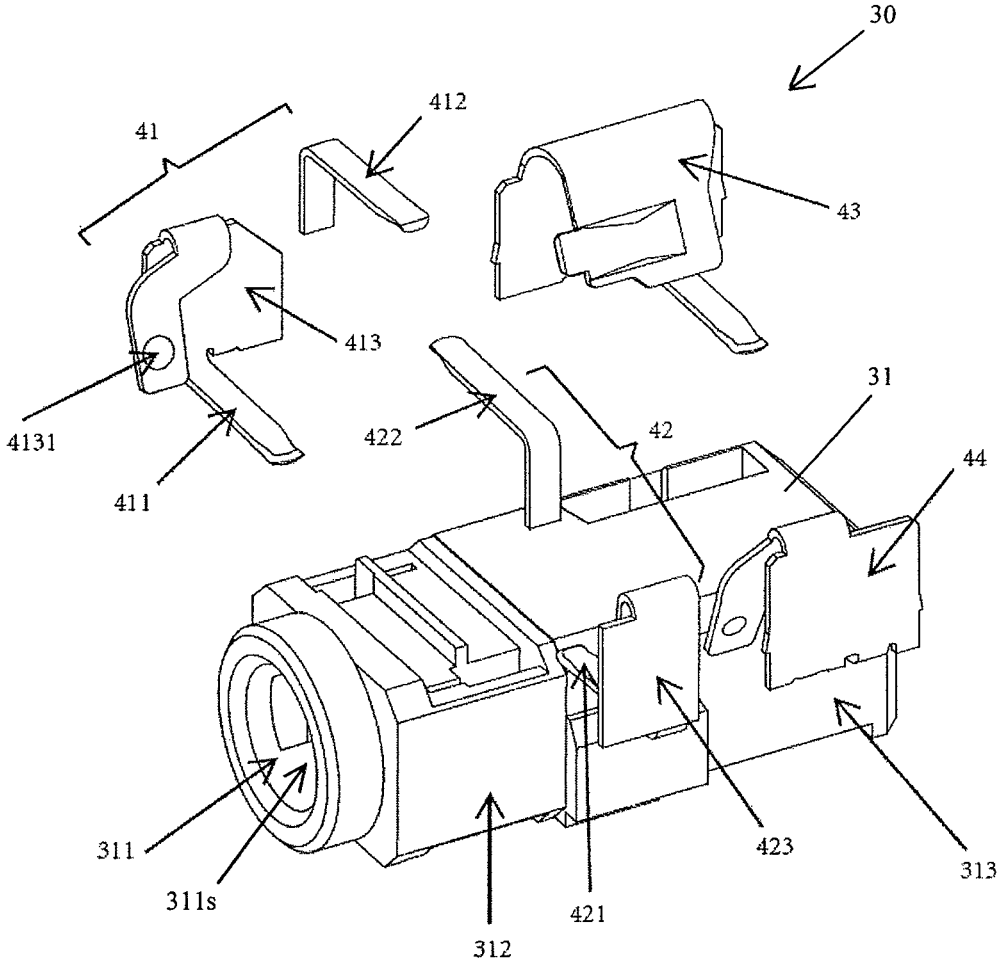
FIG. 4 illustrates an exploded view of the structure of an audio jack according to an embodiment of the present invention.
Figure 5:
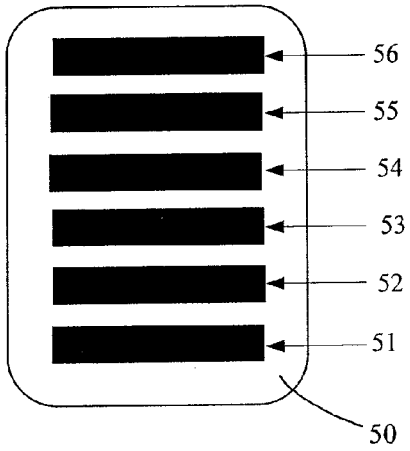
FIG. 5 illustrates a schematic diagram of a pin of a printed circuit board of an audio jack according to an embodiment of the present invention.

FIG. 4 illustrates an exploded view of an audio jack 30 according to an embodiment of the present invention. FIG. 4 illustrates the top of the audio jack in a default state. FIG. 5 illustrates a schematic diagram of a pin arrangement (or terminals arrangement) of a printed circuit board 50 of an audio jack 30 according to an embodiment of the present invention. Reference is made to FIGS. 4 and 5.

As shown in FIG. 5, the printed circuit board 50 of the audio jack 30 of this embodiment includes a first pin (or terminal) 51, a second pin 52, a third pin 53, a fourth pin 54, a fifth pin 55 and a sixth pin 56. In an embodiment, the first pin 51 is a GND contact pad, the second pin 52 is an MIC contact pad, the third pin 53 is a speaking right (SPKR) pin contact pad, the fourth pin 54 and the fifth pin 55 are insertion detection pin contact pads, and the sixth pin 56 is a speaking left (SPKL) pin contact pad. In another embodiment, the first pin 51 is an MIC contact pad, the second pin 52 is a GND contact pad, and other pins are unchanged. The printed circuit board of the audio jack of this embodiment is arranged at the bottom of the audio jack, and its pins are in contact with the elastic terminals of the audio jack, thereby carrying out the function of the audio jack.

As shown in FIG. 4, in this embodiment, a first elastic terminal 41 and a second elastic terminal 42 are arranged at the rotating portion 312 and have respectively a first extending portion 411, 421 and a second extending portion 412, 422 and a body portion 413, 423 arranged between the first extending portion 411, 421 and the second extending portion 412, 422.

As shown in FIG. 4, when the audio jack is in a default state, the rotating portion 312 is in a first position, and the first extending portion 411 of the first elastic terminal 41 is positioned on the bottom of the audio jack and is close to the opening 311, thereby contacting the first pin 51 of the printed circuit board of the audio jack; and the first extending portion 421 of the second elastic terminal 42 is positioned on the bottom of the audio jack and is close to the fixed portion 313, thereby contacting the second pin 52 of the printed circuit board 50 of the audio jack As shown in FIG. 4, when the rotating portion 312 rotates relative to the fixed portion 313 to a second position, for example, rotates 180 degrees, the relative position of the two extending portions of the first elastic terminal 41 and the second elastic terminal 42 are changed. For example, the first extending portion 411 of the first elastic terminal 41 moves to the top from the bottom of the audio jack and is out of contact with the printed circuit board 50, and the first extending portion 421 of the second elastic terminal 42 moves to the top from the bottom of the audio jack and may be in contact with the printed circuit board. Since the second extending portion 412 of the first elastic terminal 41 is close to the fixed portion, it may be in contact with the second pin 52 of the printed circuit board 50. Likewise, the second extending portion 422 of the second elastic terminal 42 moves to the top from the bottom of the audio jack and may be in contact with the printed circuit board. Since the second extending portion 422 of the second elastic terminal 42 is close to the opening 311, it may be in contact with the first pin 51 of the printed circuit board.

In this embodiment, despite of whether the rotating portion 312 is in the first position or rotates relative to the fixed portion 313 to the second position, when the plug is inserted into the accommodation space 311*s* of the insulated housing through the opening 311, the first elastic terminal 41 is in contact with the first pin of the plug, and the second elastic terminal 42 is in contact with the second pin of the plug. The first pin is the innermost pin of the plug, and the second pin is the pin next to the first pin.

In an embodiment, a first pin contact portion 4131 is arranged on the body portion 413 of the first elastic terminal 41, which extends into the accommodation space 311*s* of the insulated housing through a hole provided in a first side of the rotating portion 312, and is in contact with the first pin of the plug when the plug is inserted into the accommodation space of the insulated housing through the opening 311. Likewise, a second pin contact portion (not shown) is arranged on the body portion 423 of the second elastic terminal 42, which extends into the accommodation space 311*s* of the insulated housing through a hole provided in a fourth side of the rotating portion 312, and is in contact with the second pin of the plug when the plug is inserted into the accommodation space of the insulated housing through the opening 311.

The first pin contact portion 4131 arranged on the body portion 413 of the first elastic terminal 41 is close to the opening 311, and the second pin contact portion arranged on the body portion 423 of the second elastic terminal 42 is close to the fixed portion 313. With such a structure, when the plug is inserted into the accommodation space of the insulated housing through the opening 311, no matter the rotating portion 312 is in the first position or in the second position, the first elastic terminal 41 may be in contact with the innermost pin, i.e. the first pin, of the plug, and the second elastic terminal 42 may be in contact with the second pin next to the innermost pin.

The first side and the fourth side of the rotating portion 312 are opposite sides of the rotating portion 312. In an embodiment, the first side and the fourth side of the rotating portion 312 are arranged in parallel.

In this embodiment, other elastic terminals are arranged on the fixed portion 313, such as the elastic terminal 43 in contact with the speaking left pin of the plug and the speaking left pin contact pad on the printed circuit board, the elastic terminal 44 in contact with the speaking right pin of the plug and the speaking right pin contact pad on the printed circuit board, and the elastic terminals in contact with the insertion detection pin contact pads on the printed circuit board, etc. The positions and structures of the elastic terminals arranged on the fixed portion 313 may be the same as those of the elastic terminals on an existing audio jack, which shall not be described any further.

With the above structure of the audio jack, when the rotating portion 312 is in different positions, the elastic terminals in contact with the same pin contact pads of the printed circuit board 50 of the audio jack will be changed, while those in contact with the same pins of the plug will not be changed.

Thus, the audio jack of this embodiment may be applicable to plugs of two different specifications, with no need of changing the printed circuit board.

The structures of the first elastic terminal 41 and the second elastic terminal 42 will be described below in detail with reference to FIG. 4.

In this embodiment, the body portion 413 of the first elastic terminal 41 is arranged at a first side of the rotating portion 312. The first extending portion 411 of the first elastic terminal 41 is arranged at a second side of the rotating portion 312 perpendicular to the first side, close to the opening 311, and exposed from the rotating portion 312. The second extending portion 412 of the first elastic terminal 41 is arranged at a third side of the rotating portion 312 perpendicular to the first side, close to the fixed portion 313 and exposed from the rotating portion 312. The projections of the first extending portion 411 of the first elastic terminal 41 and the second extending portion 412 of the first elastic terminal 41 on the plane of the second side or the third side of the rotating portion 312 are spaced apart at a certain distance. As shown in FIG. 4, the first extending portion 411 and the second extending portion 412 of the first elastic terminal 41 are respectively positioned on an upper face and a lower face, i.e. the second side and the third side, of the rotating portion 312, and the first extending portion 411 and the second extending portion 412 are arranged in a staggered manner, that is, their projections on the upper face and the lower face are spaced apart at a certain distance.

The first extending portion 411, the second extending portion 412 and the body portion 413 of the first elastic terminal 41 may be formed integrally, or may be otherwise electrically connected. In this embodiment, the first extending portion 411 and the body portion 413 of the first elastic terminal 41 is formed integrally, while the second extending portion 412 and the body portion 413 of the first elastic terminal 41 is not formed integrally, but are electrically connected when they are inserted into the rotating portion 312.

The first pin contact portion 4131 arranged on the body portion 413 may be formed by bending an end of the body portion 413 and extending it towards the accommodation space 311*s* of the insulated housing 31, or may be formed otherwise.

In this embodiment, the body portion 423 of the second elastic terminal 42 is arranged at a fourth side of the rotating portion 312 perpendicular to the first side. The first extending portion 421 of the second elastic terminal 42 is arranged at a second side of the rotating portion 312 perpendicular to the first side, close to the fixed portion 313, and exposed from the rotating portion 312. The second extending portion 422 of the second elastic terminal 42 is arranged at a third side of the rotating portion 312 perpendicular to the first side, close to the opening 311 and exposed from the rotating portion 312. The projections of the first extending portion 421 of the second elastic terminal 42 and the second extending portion 422 of the second elastic terminal 42 on the plane of the second side or the third side of the rotating portion 312 are spaced apart at a certain distance. As shown in FIG. 4, the first extending portion 421 and the second extending portion 422 of the second elastic terminal 42 are respectively positioned on an upper face and a lower face, i.e. the second side and the third side, of the rotating portion 312, and the first extending portion 421 and the second extending portion 422 are arranged in a staggered manner, that is, their projections on the upper face and the lower face are spaced apart at a certain distance.

The first extending portion 421, the second extending portion 422 and the body portion 423 of the second elastic terminal 42 may be formed integrally, or may be otherwise electrically connected. In this embodiment, the first extending portion 421 and the body portion 423 of the second elastic terminal 42 are formed integrally, while the second extending portion 422 and the body portion 423 of the second elastic terminal 42 are not formed integrally, but are electrically connected when they are inserted into the rotating portion 312.

The second pin contact portion arranged on the body portion 423 may be formed by bending an end of the body portion 423 and extending it towards the accommodation space of the insulated housing, or may be formed otherwise.

In this embodiment, the projections of the first extending portion 411 of the first elastic terminal 41 and the second extending portion 422 of the second elastic terminal 42 on the plane of the second side or the third side of the rotating portion 312 are overlapped, and the projections of the second extending portion 412 of the first elastic terminal 41 and the first extending portion 421 of the second elastic terminal 42 on the plane of the second side or the third side of the rotating portion 312 are overlapped.

With the above structures of the first elastic terminal 41 and the second elastic terminal 42, in a default state, i.e. when the rotating portion 312 is in the first position, as shown in FIG. 4, the first extending portion 411 of the first elastic terminal 41 is in contact with the first pin 51 of the printed circuit board 50 of the audio jack 30, and the first extending portion 421 of the second elastic terminal 42 is in contact with the second pin 52 of the printed circuit board of the audio jack. When the rotating portion 312 rotates relative to the fixed portion 313 to the second position, for example, rotates 180 degrees to the second position, since the positional relationship between the first elastic terminal 41 and the second elastic terminal 42 is changed, the second extending portion 422 of the second elastic terminal 42 is in contact with the first pin 51 of the printed circuit board 50 of the audio jack 30, and the second extending portion 412 of the first elastic terminal 41 is in contact with the second pin 52 of the printed circuit board of the audio jack. Since the first pin 51 and the second pin 52 of the printed circuit board of the audio jack are fixed, the rotation of the rotating portion 312 is realized, causing the audio jack to support plugs of different specifications. And since the printed circuit board 50 is unchanged, when the audio jack 30 is applied to an electronic apparatus, the range of application of the electronic apparatus is increased on the premise of reducing the cost of the electronic apparatus.

The effect of the audio jack 30 of the embodiments of the present invention will be described below with reference to a schematic diagram of the operational state of the audio jack of the embodiments of the present invention. In this embodiment, take that the first pin of the audio jack is a GND pad and the second pin is an MIC pad as an example.

Figure 6A:
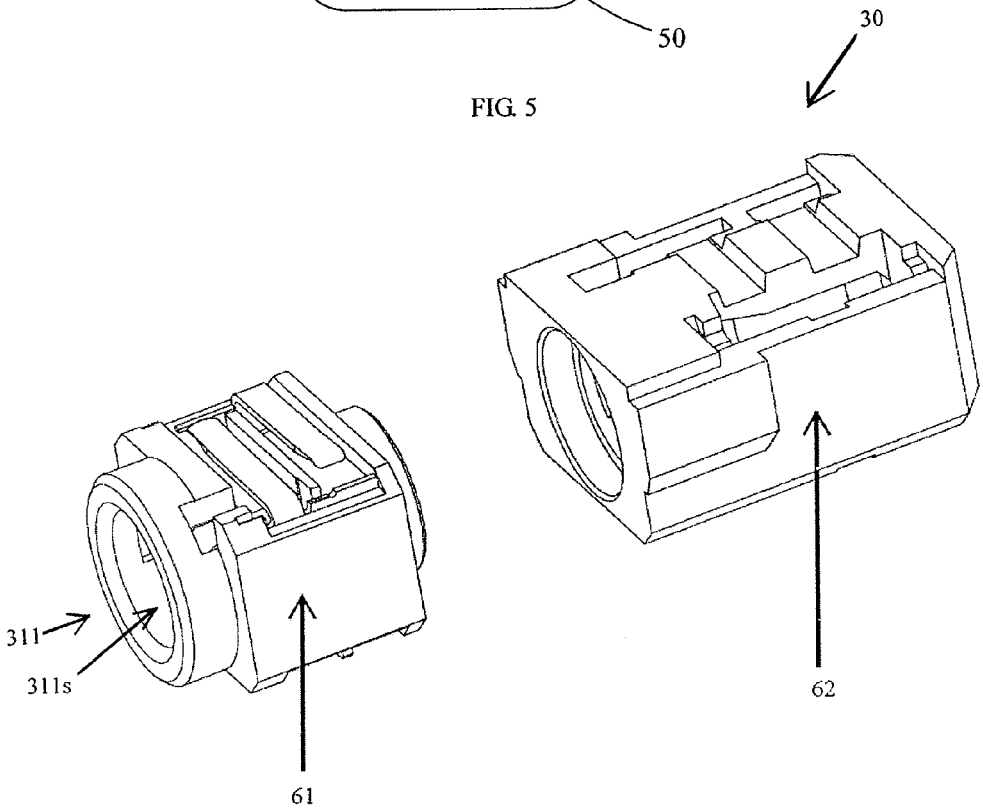
FIG. 6*a* illustrates a schematic diagram of the bottom of an audio jack according to an embodiment of the present invention.
Figure 6B:
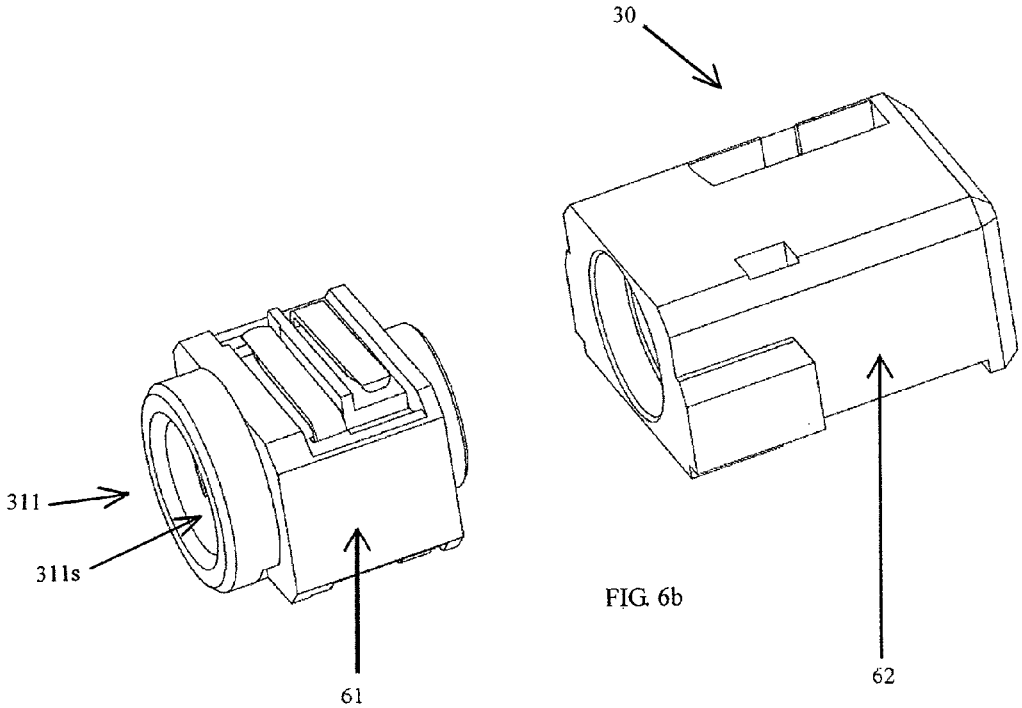
FIG. 6*b* illustrates a schematic diagram of the top of an audio jack according to an embodiment of the present invention.

FIGS. 6*a* and 6*b* illustrate schematic diagrams of the compositions of the audio jack 30 according to the embodiments of the present invention. As shown in FIGS. 6*a* and 6*b*, the insulated housing includes a rotating portion 61 and a fixed portion 62, the rotating portion 61 being rotatable relative to the fixed portion 62. The structures of the rotating portion 61 and the fixed portion 62 are identical those shown in FIG. 4 (also described above with reference to reference numerals 312, 313, respectively), which shall not be described any further. FIG. 6*a* illustrates the bottom of the audio jack, and FIG. 6*b* illustrates the top of the audio jack.

Figure 6C:
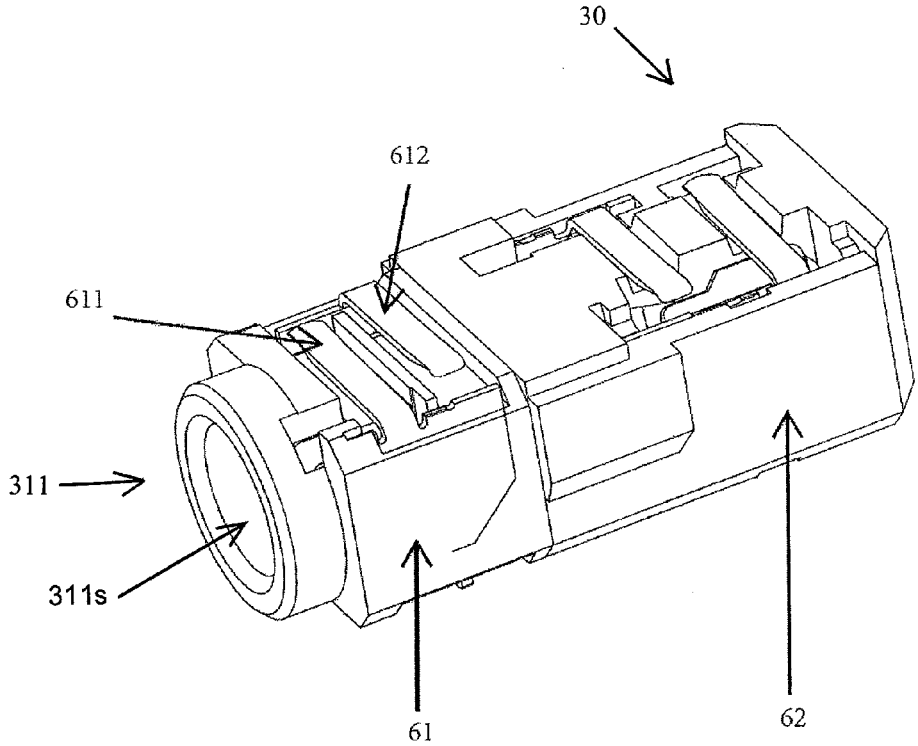
FIG. 6*c* illustrates a schematic diagram of the rotating portion and the fixed portion of the audio jack shown in FIG. 6*a* which are connected.

FIG. 6*c* illustrates a schematic diagram of the rotating portion 61 and the fixed portion 62 of the audio jack 30 shown in FIG. 6*a* which are connected. As shown in FIG. 6*c*, a first elastic terminal 611 arranged at the rotating portion 61 is exposed from the rotating portion 61, the exposed portion (the first extending portion of the first elastic terminal 611) being close to the opening and in contact with the GND pad 51 of the printed circuit board 50 of the audio jack 30; and a second elastic terminal 612 arranged at the rotating portion 61 is exposed from the rotating portion 61, the exposed portion (the first extending portion of the second elastic terminal 612) being close to the fixed portion 62 and in contact with the MIC pad 52 of the printed circuit board 50 of the audio jack 30. When a plug in conformity with the OMTP specification is inserted into the accommodation space 311*s* of the audio jack 30 from the opening 311 of the audio jack, the first elastic terminal 611 of the rotating portion 61 is in contact with the GND pin of the plug and the GND pad of the printed circuit board, and the second elastic terminal 612 of the rotating portion 61 is in contact with the MIC pin of the plug and the MIC pad of the printed circuit board. Thus, the audio jack is capable of supporting the plug of the OMTP specification.

Figure 6D:
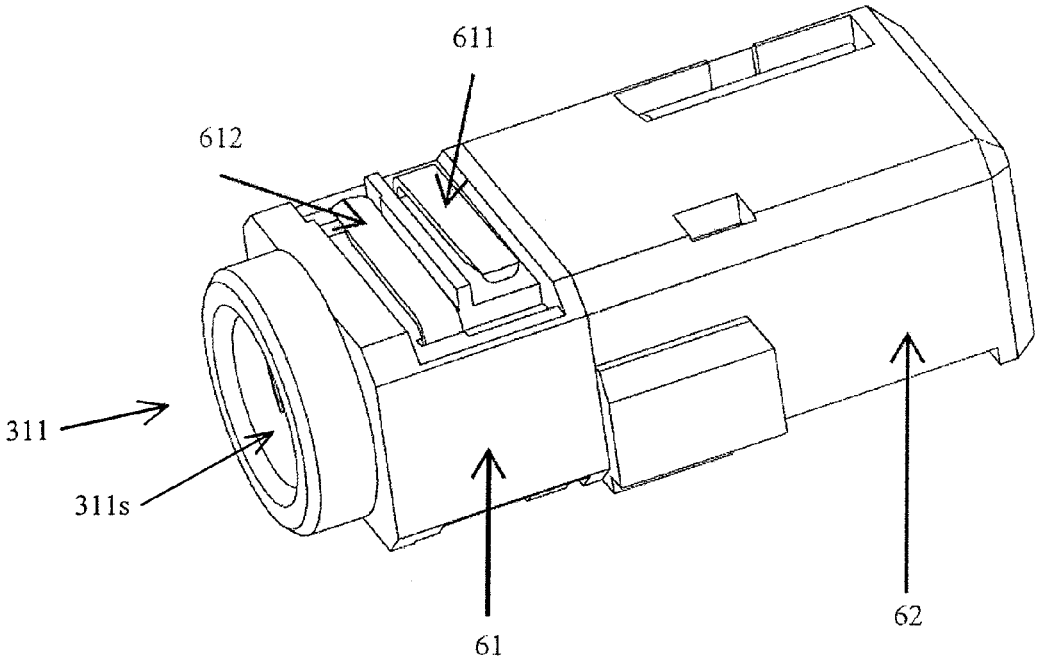
FIG. 6*d* illustrates a schematic diagram of the rotating portion and the fixed portion of the audio jack shown in FIG. 6*b* which are connected.

FIG. 6*d* illustrates a schematic diagram of the rotating portion 61 and the fixed portion 62 of the audio jack 30 shown in FIG. 6*b* which are connected. As shown in FIG. 6*d*, the first elastic terminal 611 arranged at the rotating portion 61 is exposed from the rotating portion 61, the exposed portion (the second extending portion of the first elastic terminal 611) being close to the fixed portion 62; and the second elastic terminal 612 arranged at the rotating portion 61 is exposed from the rotating portion 61, the exposed portion (the second extending portion of the second elastic terminal 612) being close to the opening. In comparison with what is shown in the schematic diagram of FIG. 6*c*, the portion of the first elastic terminal 611 exposed from the rotating portion 61 is close to the fixed portion 62, and the portion of the second elastic terminal 612 exposed from the rotating portion 61 is close to the opening. Therefore, when the rotating portion 61 rotates 180 degrees relative to the fixed portion 62 to the position or orientation shown in FIG. 6*d*, the relative position of the elastic terminal arranged on the fixed portion 62 will not be changed and, similar to what is shown in FIG. 6*c*, is still in contact with a corresponding pin (terminal) pad of the printed circuit board 50 of the audio jack 30, while the first elastic terminal 611 and the second elastic terminal 612 in contact with the GND pad and the MIC pad of the printed circuit board of the audio jack will be changed. Relative to the showing in FIG. 6*c*, after rotation of the rotating portion 61 to the orientation shown in FIG. 6*d*, the second elastic terminal 612 is in contact with the GND pad of the printed circuit board, and the first elastic terminal 611 is in contact with the MIC pad of the printed circuit board. When a plug in conformity with the CTIA specification is inserted into the accommodation space of the audio jack from the opening of the audio jack, the first elastic terminal 611 of the rotating portion 61 is in contact with the MIC pin of the plug and the MIC pad of the printed circuit board, and the second elastic terminal 612 of the rotating portion 61 is in contact with the GND pin of the plug and the GND pad of the printed circuit board. Thus, the audio jack is capable of supporting the plug of the CTIA specification.

It can be seen from the operational state of the audio jack of the embodiments of the present invention as illustrated in FIGS. 6*a*-6*d* that the audio jack of the embodiments of the present invention may support plugs of two different specifications, and use one printed circuit board. Hence, not only the cost of manufacture is saved, but also the range of application is increased.

Figure 7:
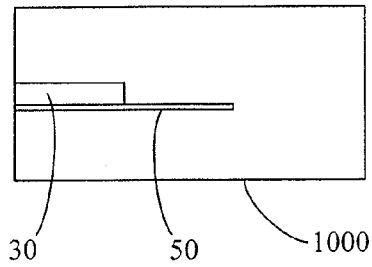
FIG. 7 is a schematic illustration of an electronic apparatus with an audio jack.

According to still another embodiment of the present invention, there is provided an electronic apparatus 1000, as is illustrated schematically in FIG. 7. The electronic apparatus includes an audio jack 30 for insertion of a plug. The audio jack includes a hollow insulated housing having an opening, an accommodation space being formed within the insulated housing for accommodating the plug inserted from the opening, and a plurality of elastic terminals being arranged on the insulated housing.

In this embodiment, the insulated housing includes a fixed portion and a rotating portion rotating relative to the fixed portion and on which at least two elastic terminals are arranged; the at least two elastic terminals of the rotating portion being in contact with different pins of a printed circuit board 50 of the audio jack 30 respectively when the rotating portion is in a first position and rotates relative to the fixed portion to a second position.

In an embodiment, the rotating portion and the fixed portion are connected in a nested manner. A first elastic terminal and second elastic terminal are arranged on the rotating portion and having respectively a first extending portion, a second extending portion and a body portion arranged between the first extending portion and the second extending portion.

When the rotating portion is at the first position, the first extending portion of the first elastic terminal is in contact with a first pin of the printed circuit board of the audio jack, and the first extending portion of the second elastic terminal is in contact with a second pin of the printed circuit board of the audio jack.

When the rotating portion rotates relative to the fixed portion to the second position, the second extending portion of the second elastic terminal is in contact with the first pin of the printed circuit board of the audio jack, and the second extending portion of the first elastic terminal is in contact with the second pin of the printed circuit board of the audio jack.

In an embodiment, the first pin is a GND contact pad, and the second pin is an MIC contact pad. In another embodiment, the first pin is an MIC contact pad, and the second pin is a GND contact pad.

In an embodiment, the body portion of the first elastic terminal is arranged at a first side of the rotating portion;

the first extending portion of the first elastic terminal is arranged at a second side of the rotating portion perpendicular to the first side, close to the opening and exposed from the rotating portion;

the second extending portion of the first elastic terminal is arranged at a third side of the rotating portion perpendicular to the first side, close to the fixed portion and exposed from the rotating portion;

wherein the projections of the first extending portion of the first elastic terminal and the second extending portion of the first elastic terminal on the plane of the second side or the third side of the rotating portion are spaced apart at a certain distance.

In an embodiment, the body portion of the second elastic terminal is arranged at a fourth side of the rotating portion in parallel with the first side;

the first extending portion of the second elastic terminal is arranged at the second side of the rotating portion perpendicular to the first side, close to the fixed portion and exposed from the rotating portion;

the second extending portion of the second elastic terminal is arranged at the third side of the rotating portion perpendicular to the first side, close to the opening and exposed from the rotating portion;

wherein the projections of the first extending portion of the second elastic terminal and the second extending portion of the second elastic terminal on the plane of the second side or the third side of the rotating portion are spaced apart at a certain distance.

In an embodiment, the projections of the first extending portion of the first elastic terminal and the second extending portion of the second elastic terminal on the plane of the second side or the third side of the rotating portion are overlapped; and the projections of the second extending portion of the first elastic terminal and the first extending portion of the second elastic terminal on the plane of the second side or the third side of the rotating portion are overlapped.

In this embodiment, the audio jack of the electronic apparatus may be realized by using the audio jack shown in FIG. 4. The contents of the audio jack shown in FIG. 4 are incorporated herein, which shall not be described any further.

An audio jack capable of supporting plugs of two different specifications is used in the electronic apparatus of the embodiments of the present invention, which realizes the support of plugs of two different specifications, not only saving the cost of manufacture, but also increasing the range of application of the electronic apparatus.

The preferred embodiments of the present invention are described above with reference to the drawings. The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

The invention claimed is:

1. An audio jack, comprising a hollow insulated housing that has an opening for accommodating a plug inserted into the hollow insulated housing through the opening, wherein the insulated housing comprises: a fixed portion and a rotating portion rotating relative to the fixed portion and on which at least two elastic terminals are arranged;

the at least two elastic terminals of the rotating portion being in contact with different pins of a printed circuit board of the audio jack respectively when the rotating portion is in a first position and rotates relative to the fixed portion to a second position;

a first elastic terminal and a second elastic terminal are arranged on the rotating portion and have respectively a first extending portion and a second extending portion and a body portion arranged between the first extending portion and the second extending portion;

when the rotating portion is at the first position, the first extending portion of the first elastic terminal is in contact with a first pin of the printed circuit board of the audio jack, and the first extending portion of the second elastic terminal is in contact with a second pin of the printed circuit board of the audio jack; and when the rotating portion rotates relative to the fixed portion to the second position, the second extending portion of the second elastic terminal is in contact with the first pin of the printed circuit board of the audio lack, and the second extending portion of the first elastic terminal is in contact with the second pin of the printed circuit board of the audio jack.

2. The audio jack according to claim 1, wherein, the body portion of the first elastic terminal is arranged at a first side of the rotating portion;

the first extending portion of the first elastic terminal is arranged at a second side of the rotating portion perpendicular to the first side, close to the opening and exposed from the rotating portion;

the second extending portion of the first elastic terminal is arranged at a third side of the rotating portion perpendicular to the first side, close to the fixed portion and exposed from the rotating portion;

wherein the projections of the first extending portion of the first elastic terminal and the second extending portion of the first elastic terminal on the plane of the second side or the third side of the rotating portion are spaced apart at a certain distance.

3. The audio jack according to claim 2, wherein the body portion of the second elastic terminal is arranged at a fourth side of the rotating portion in parallel with the first side;

the first extending portion of the second elastic terminal is arranged at the second side of the rotating portion perpendicular to the first side, close to the fixed portion and exposed from the rotating portion;

the second extending portion of the second elastic terminal is arranged at the third side of the rotating portion perpendicular to the first side, close to the opening and exposed from the rotating portion;

wherein the projections of the first extending portion of the second elastic terminal and the second extending portion of the second elastic terminal on the plane of the second side or the third side of the rotating portion are spaced apart at a certain distance.

4. The audio jack according to claim 3, wherein the projections of the first extending portion of the first elastic terminal and the second extending portion of the second elastic terminal on the plane of the second side or the third side of the rotating portion are overlapped; and the projections of the second extending portion of the first elastic terminal and the first extending portion of the second elastic terminal on the plane of the second side or the third side of the rotating portion are overlapped.

5. The audio jack according claim 1, wherein the first pin is a GND contact pad, and the second pin is an MIC contact pad; or the first pin is an MIC contact pad, and the second pin is a GND contact pad.

6. The audio jack according to claim 1, wherein the rotating portion and the fixed portion are connected in a nested manner, and a clamp for preventing the rotating portion from sliding relative to the fixed portion is arranged at the position where the rotating portion and the fixed portion are connected.

7. The audio jack according claim 2, wherein the first pin is a GND contact pad, and the second pin is an MIC contact pad; or the first pin is an MIC contact pad, and the second pin is a GND contact pad.

8. The audio jack according claim 3, wherein the first pin is a GND contact pad, and the second pin is an MIC contact pad; or the first pin is an MIC contact pad, and the second pin is a GND contact pad.

9. The audio jack according claim 4, wherein the first pin is a GND contact pad, and the second pin is an MIC contact pad; or the first pin is an MIC contact pad, and the second pin is a GND contact pad.

10. The audio jack according to claim 2, wherein the rotating portion and the fixed portion are connected in a nested manner, and a clamp for preventing the rotating portion from sliding relative to the fixed portion is arranged at the position where the rotating portion and the fixed portion are connected.

11. The audio jack according to claim 3, wherein the rotating portion and the fixed portion are connected in a nested manner, and a clamp for preventing the rotating portion from sliding relative to the fixed portion is arranged at the position where the rotating portion and the fixed portion are connected.

12. The audio jack according to claim 4, wherein the rotating portion and the fixed portion are connected in a nested manner, and a clamp for preventing the rotating portion from sliding relative to the fixed portion is arranged at the position where the rotating portion and the fixed portion are connected.

13. An electronic apparatus, the electronic apparatus comprising an audio jack, and the audio jack comprising a hollow insulated housing, wherein, the insulated housing comprises: a fixed portion and a rotating portion rotating relative to the fixed portion and on which at least two elastic terminals are arranged;

the at least two elastic terminals of the rotating portion being in contact with different pins of a printed circuit board of the audio jack respectively when the rotating portion is in a first position and rotates relative to the fixed portion to a second position;

a first elastic terminal and a second elastic terminal are arranged on the rotating portion and have respectively a first extending portion, a second extending portion and a body portion arranged between the first extending portion and the second extending portion;

when the rotating portion is at the first position, the first extending portion of the first elastic terminal is in contact with a first pin of the printed circuit board of the audio jack, and the first extending portion of the second elastic terminal is in contact with a second pin of the printed circuit board of the audio lack; and when the rotating portion rotates relative to the fixed portion to the second position, the second extending portion of the second elastic terminal is in contact with the first pin of the printed circuit board of the audio jack, and the second extending portion of the first elastic terminal is in contact with the second pin of the printed circuit board of the audio jack.

14. The electronic apparatus according to claim 13, wherein, the body portion of the first elastic terminal is arranged at a first side of the rotating portion;

the first extending portion of the first elastic terminal is arranged at a second side of the rotating portion perpendicular to the first side, close to the opening and exposed from the rotating portion;

the second extending portion of the first elastic terminal is arranged at a third side of the rotating portion perpendicular to the first side, close to the fixed portion and exposed from the rotating portion;

wherein the projections of the first extending portion of the first elastic terminal and the second extending portion of the first elastic terminal on the plane of the second side or the third side of the rotating portion are spaced apart at a certain distance;

the body portion of the second elastic terminal is arranged at a fourth side of the rotating portion in parallel with the first side;

the first extending portion of the second elastic terminal is arranged at the second side of the rotating portion perpendicular to the first side, close to the fixed portion and exposed from the rotating portion;

the second extending portion of the second elastic terminal is arranged at the third side of the rotating portion perpendicular to the first side, close to the opening and exposed from the rotating portion;

wherein the projections of the first extending portion of the second elastic terminal and the second extending portion of the second elastic terminal on the plane of the second side or the third side of the rotating portion are spaced apart at a certain distance.

* * * * *

UNITED STATES PATENT AND TRADEMARK OFFICE

CERTIFICATE OF CORRECTION

PATENT NO. : 8,662,937 B2
APPLICATION NO. : 13/556600
DATED : March 4, 2014
INVENTOR(S) : Xiyong Tian et al.

It is certified that error appears in the above-identified patent and that said Letters Patent is hereby corrected as shown below:

In the Claims

Claim 1, col 13, line 61 should read -- "pin of the printed circuit board of the audio jack, and the"

Claim 13, col 15, line 38 should read -- "circuit board of the audio jack; and"

Signed and Sealed this
Third Day of June, 2014

Michelle K. Lee

Michelle K. Lee
*Deputy Director of the United States Patent and Trademark Office*